US005608295A

United States Patent [19]

Moisin

[11] Patent Number: 5,608,295

[45] Date of Patent: Mar. 4, 1997

[54] COST EFFECTIVE HIGH PERFORMANCE CIRCUIT FOR DRIVING A GAS DISCHARGE LAMP LOAD

[75] Inventor: Mihail S. Moisin, Lake Forest, Ill.

[73] Assignee: Valmont Industries, Inc., Valley, Nebr.

[21] Appl. No.: 299,124

[22] Filed: Sep. 2, 1994

[51] Int. Cl.[6] ..... H05B 37/02; H05B 41/29

[52] U.S. Cl. ..... 315/247; 315/307; 315/209 R; 315/DIG. 7; 315/278; 315/219; 315/324; 323/205; 323/207; 363/44; 363/84

[58] Field of Search ..... 315/247, DIG. 7, 315/323, 325, 209 R, 291, 307, 220, 324, 219, 278; 323/205, 207; 363/61, 44, 39, 84

[56] References Cited

U.S. PATENT DOCUMENTS

| | | | |
|---|---|---|---|
| 3,936,696 | 2/1976 | Gray | 315/210 |
| 3,967,159 | 6/1976 | Dendy et al. | 315/247 |
| 4,109,307 | 8/1978 | Knoll | 363/101 |
| 4,188,660 | 2/1980 | Knoll | 363/49 |
| 4,222,096 | 9/1980 | Capewell | 363/44 |
| 4,251,752 | 2/1981 | Stolz | 315/206 |
| 4,352,045 | 9/1982 | Widmayer | 315/291 |
| 4,370,600 | 1/1983 | Zansky | 315/244 |

(List continued on next page.)

FOREIGN PATENT DOCUMENTS

| | | | |
|---|---|---|---|
| 0093469 | 11/1983 | European Pat. Off. | 315/219 |
| 0599405A1 | 6/1994 | European Pat. Off. . | |
| 599405 | 6/1994 | European Pat. Off. . | |
| 0606665A1 | 7/1994 | European Pat. Off. . | |
| 2700434 | 7/1994 | France . | |
| 2106339 | 4/1983 | United Kingdom | 315/219 |
| 9204808 | 3/1992 | WIPO . | |
| WO92/22186 | 12/1992 | WIPO | 315/219 |
| WO93/07732 | 4/1993 | WIPO . | |

*Primary Examiner*—Benny Lee
*Assistant Examiner*—Arnold Kinkead
*Attorney, Agent, or Firm*—Zarley, McKee, Thomte, Voorhees & Sease

[57] ABSTRACT

A circuit for driving a gas discharge lamp load and including an EMI and transient supply filter coupled to an input source, a rectifier coupled to the filter, a power inverter coupled to the rectifier, a load including a transformer coupled to the power inverter, and a control circuit coupled to the power inverter and the load. A feedback circuit couples the load transformer to the AC side of the rectifier to create a path for transferring a feedback voltage over the rectifier to cause the rectifier to conduct current over a substantive portion of each cycle of the AC input voltage.

62 Claims, 3 Drawing Sheets

U.S. PATENT DOCUMENTS

| | | | |
|---|---|---|---|
| 4,392,087 | 7/1983 | Zansky | 315/219 |
| 4,463,285 | 7/1984 | Nilssen | 315/205 |
| 4,463,287 | 7/1984 | Pitel | 315/291 |
| 4,496,880 | 1/1985 | Luck | 315/228 |
| 4,523,128 | 6/1985 | Stamm et al. | 315/291 |
| 4,523,131 | 6/1985 | Zansky | 315/307 |
| 4,525,649 | 6/1985 | Knoll et al. | 315/96 |
| 4,713,045 | 12/1987 | Van Meurs | 315/224 |
| 4,719,390 | 1/1988 | Sairanen | 315/246 |
| 4,808,887 | 2/1989 | Fahnrich et al. | 315/247 |
| 4,862,041 | 8/1989 | Hirschmann | 315/246 |
| 4,885,508 | 12/1989 | Krokaugger | 315/287 |
| 4,904,906 | 2/1990 | Atherton et al. | 315/291 |
| 4,928,038 | 5/1990 | Nerone | 315/209 |
| 4,939,427 | 7/1990 | Nilssen | 315/209 |
| 4,985,664 | 1/1991 | Nilssen | 315/209 |
| 5,001,386 | 3/1991 | Sullivan et al. | 315/219 |
| 5,001,400 | 3/1991 | Nilssen | 315/209 |
| 5,030,887 | 7/1991 | Guisinger | 315/158 |
| 5,041,766 | 8/1991 | Fiene et al. | 315/219 |
| 5,057,749 | 10/1991 | Nilssen | 315/247 |
| 5,097,181 | 3/1992 | Kakitani | 315/209 |
| 5,097,182 | 3/1992 | Kelly | 315/219 |
| 5,099,407 | 3/1992 | Thorne | 363/37 |
| 5,101,142 | 3/1992 | Chatfield | 315/308 |
| 5,115,347 | 5/1992 | Nilssen | 315/247 |
| 5,117,161 | 5/1992 | Avrahami | 315/226 |
| 5,124,619 | 6/1992 | Moisin et al. | 315/219 |
| 5,138,234 | 8/1992 | Moisin | 315/209 |
| 5,138,236 | 8/1992 | Bobel et al. | 315/209 |
| 5,142,202 | 8/1992 | Sun et al. | 315/225 |
| 5,144,195 | 9/1992 | Konopka et al. | 315/94 |
| 5,146,139 | 9/1992 | Nilssen | 315/205 |
| 5,148,087 | 9/1992 | Moisin et al. | 315/291 |
| 5,165,053 | 11/1992 | Jones | 315/224 |
| 5,172,034 | 12/1992 | Brinkerhoff | 315/307 |
| 5,180,950 | 1/1993 | Nilssen | 315/127 |
| 5,191,262 | 3/1993 | Nilssen | 315/209 |
| 5,212,427 | 5/1993 | Jones | 315/224 |
| 5,218,272 | 6/1993 | Jones | 315/247 |
| 5,220,247 | 6/1993 | Moisin | 315/209 |
| 5,223,767 | 6/1993 | Kulka | 315/209 R |
| 5,237,243 | 8/1993 | Chung | 315/219 |
| 5,251,119 | 10/1993 | Maehara | 363/37 |
| 5,313,142 | 5/1994 | Wong | 315/205 |
| 5,359,274 | 10/1994 | Bandel | 323/207 |

COST EFFECTIVE HIGH PERFORMANCE CIRCUIT FOR DRIVING A GAS DISCHARGE LAMP LOAD

BACKGROUND OF THE INVENTION

1. Field of the Invention

This invention relates to power factor corrected circuits for driving gas discharge lamps, in particular, though not exclusively, to circuits for driving fluorescent lamps.

2. Problems in the Art

In a typical prior art circuit for driving a fluorescent lamp load, the lamps are driven by an AC voltage supply via a rectifier and a high-frequency resonant circuit including an inverter circuit. The load is coupled to the resonant circuit by a transformer.

One goal in designing an electronic ballast circuit is to optimize the power line input performance, namely the total harmonic distortion (THD) and the power factor (PF). One reason for the poor performance (THD and PF) in prior art circuits using voltage rectification and energy storage capacitors is the non-linear characteristics of the rectifying diodes. The diodes in the voltage rectifiers will only conduit current when they are forward biased. This happens only for a very short conduction time which close to the peak of the input voltage waveform.

Some prior art circuits overcame the problem of poor power line input performance through various correction schemes (e.g., a passive harmonic trap or an active "boost converter"). However, circuits using these power factor correcting schemes require more components, involve more loss, introduce more noise, and are more expensive. Also, prior art circuits operate at a high temperature and require a heat dissipation means.

OBJECTS OF THE INVENTION

A general object of the present invention is to provide a cost effective inverter-type ballast.

Another object of the present invention is to provide an electronic ballast operative to draw power from the power line with a high power factor and a low amount of total harmonic distortion.

Another object the invention is to provide an electronic ballast which has a power factor correction scheme and reduces total harmonic distortion without adding any significant components to the circuit which would raise the cost, the noise, the operating temperature, and the power loss in the circuit.

Another object of the present invention is to reduce the cost of a high performance electronic ballast for fluorescent lamps, preserving at the same time the range of performance, i.e., total harmonic distortion less than 10% and a power factor greater than 97%.

It is another object of the present invention to provide an electronic ballast operating at high frequency (above 20 kHz) using a single active stage in order to accomplish the task of driving the lamps and for correction for the power line current waveform at the same time.

Another object of the present invention is to reduce the cost of an electronic ballast circuit by eliminating an entire active or passive stage which is traditionally used to perform the function of correcting the power line current waveform.

Another object of the present invention is to provide an electronic ballast circuit that operates at a low temperature.

These as well as other objects of the present invention will become apparent from the following specification and claims.

SUMMARY OF THE INVENTION

While the invention will be described as a preferred embodiment, it will be understood that it is not intended to limit the invention to this embodiment. On the contrary, it is intended to cover all alternatives, modifications and equivalents as may be included within the spirit and scope of the invention.

As shown in FIG. 2, the circuit can be divided into functional blocks.

The first block in FIG. 2 represents an electromagnetic interference (EMI) and transient suppression filter. One purpose of the EMI and transient suppression filter is to prevent possible radiation of radio frequency interference (RFI) from the instrument via the power line, as well as filtering out incoming interference that may be present on the power line. As FIG. 1 shows, the filter consists of inductor L1, capacitors C1, C10, and **C2*a*/C2*b*. One purpose of the C2*a*/C2*b*** combination is to provide an AC path for the power feedback from the output stage.

The rectifier stage block is connected to the EMI and transient suppression filter. The preferred embodiment of the rectifier stage consists of diodes D1, D2, D3, D4 and the bulk energy storage capacitor C3. The purpose of the rectifier stage is to rectify the AC input voltage. The rectifier stage is connected to the power inverter to provide power to the power switching devices.

FIG. 2 also illustrates the power inverter. In the preferred embodiment, the power inverter consists of half-bridge power transistors Q1 and Q2, their associated driving elements R2/C6 and R3/C7, resonating inductor LR, resonating capacitors C8, C9, and **C2*a*/C2*b*, both reflected over the load transformer T1. Other switching devices could also be used in place of transistors Q1 and Q2**. The power inverter is connected to a load transformer to provide power to a load.

FIG. 2 also illustrates the power feedback circuit utilized in this invention. A feedback voltage is taken from tap 1T on the primary side of transformer T1 and provided to the AC side of the rectifier stage. Capacitors **C2*a* and C2*b* in combination create a path for transferring the feedback voltage through the rectifier stage to the bulk capacitor C3. The purpose of the feedback circuit is to expand the conduction time of the rectifying diodes D1–D4** which would normally only conduct over a short period of time (near the peak of the AC voltage). This in turn increases the power factor and decreases the total harmonic distortion.

FIG. 2 also illustrates the control circuit. The control circuit is connected to the power inverter and the load. The primary purpose of the control circuit is to control the duty cycle of the power transistor Q2 depending on the feedback received from the load via driving winding LR-3 and current sense resistor RS.

DETAILED DESCRIPTION OF THE PREFERRED EMBODIMENT

The present invention will be described as a preferred embodiment. It is not intended that the present invention be limited to the described embodiment. On the contrary, it is intended that the invention cover all alternatives, modifications and equivalents as may be included within the spirit and scope of the invention.

The invention will be described as a preferred embodiment as applied to an electronic ballast. It is not intended that the invention be limited to electronic ballasts, since the invention could apply to, though not exclusively to, power supplies or dc motors, for example.

Figure 1:
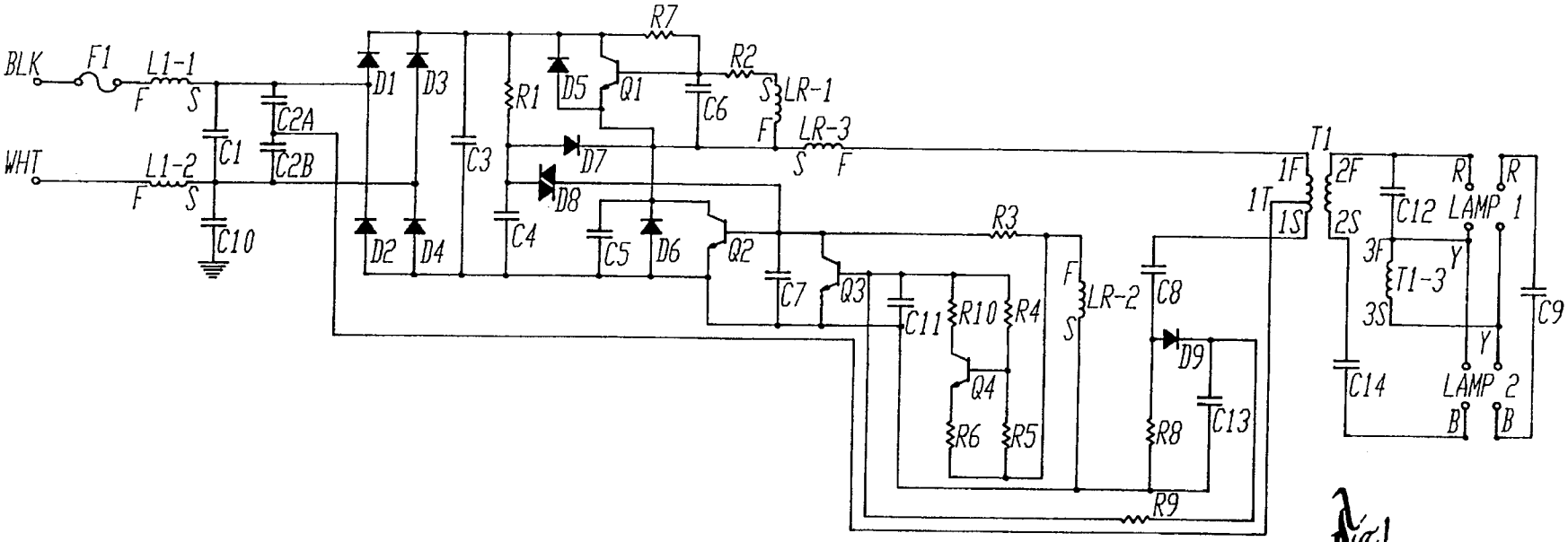
FIG. 1 shows a schematic circuit diagram of the preferred embodiment.
Figure 2:
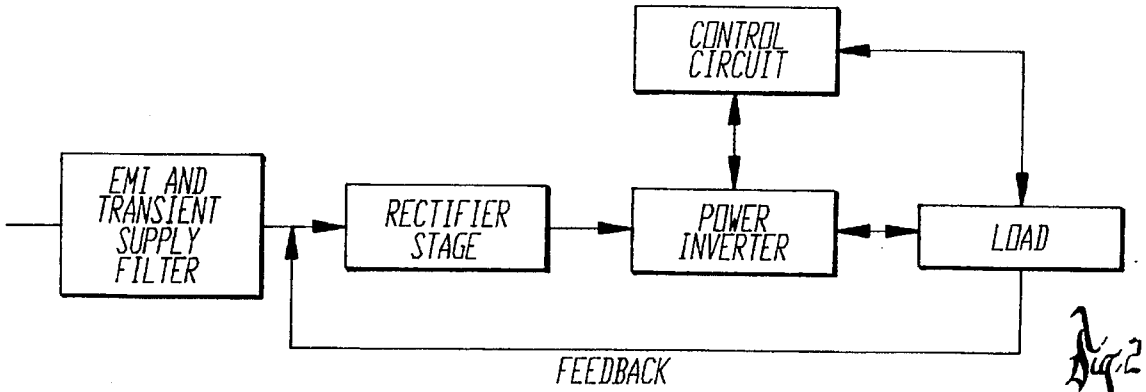
FIG. 2 shows a block diagram of the preferred embodiment.

FIG. 1 shows the AC input of the electronic ballast (BLK and WHT). The AC voltage supply first goes through fuse F1, and then to an electromagnetic interference (EMI) and transient suppression filter. Inductors L1-1, L1-2, and capacitors C1 and C10 together form the EMI and transient suppression filter. The filter helps to prevent possible radiation of radio frequency interference from the instrument via the power line, as well as filtering out incoming interference that may be present on the power line. The filter is capable of filtering both common mode noise and differential noise. In a preferred embodiment, Li-1 and L1-2 are made up of a single inductor with two coils. This configuration results in a leakage inductance which is desired. It also buffers the circuit against transients. The EMI filter in this embodiment also eliminates the use of varisters which are unreliable components.

The power inverter is a self-resonating, half-bridge type of circuit containing two power switching devices (shown as transistors Q1 and Q2 in FIG. 1) connected in a half-bridge configuration. Other types of switching devices could also be used. Transistors Q1 and Q2 are proportionally driven by two windings LR-1 and LR-2 taken from the resonating inductor LR. One problem encountered by prior art circuits configured in a half-bridge configuration is the cross-conduction (transversal) currents which occur when both transistors are turned on simultaneously. Cross-conduction is undesirable because it can result in the destruction of the circuit. Cross-conduction can occur when one transistor is turned on prematurely because of the incorrect driving of the transistor or when one transistor is turned off late because of a storage time delay. Storage time delays are present because transistors are not ideal devices. The circuit of the preferred embodiment is beneficial regarding cross-conduction because the circuit provides a "built in" protection against cross conduction.

Transistors Q1 and Q2 are driven by the voltages developed across the secondary windings (LR-1 and LR-2) of the resonating inductor LR. Note that in the preferred embodiment, transistors Q1 and Q2 are driven by the voltage across the secondary windings of the inductor LR, not by the current through them. In other words, transistors Q1 and Q2 utilize a voltage transformer which transforms voltage as opposed to a current transformer which transforms current.

The phase angles of the voltages across LR-1 and LR-2 lead by 90° the phase angles of the current flowing through the inductors which is the same current as the current flowing through the collector of each transistor per half cycle. The phase angle of the voltage is delayed by about 45° by the combination of the base drive elements R2/C6 for transistor Q1 and R3/C7 for transistor Q2, which results in the base drive signal having a 45° leading phase angle regardless of the load. This translates into about a 45° portion of each half cycle where both transistors are turned off and the resonating current through the resonating inductor LR will continue to flow through the freewheeling diodes D5 and D6. In designing the circuit, the values for the R-C combination of the base drives should be selected such that the delay time constant implemented by the R-C combination is greater than the transistor storage time. This prevents cross-conduction due to the late turning off of a transistor.

This configuration of transistors Q1 and Q2, inductor LR, and base drive elements makes it almost impossible for cross-conduction to occur. Prior art circuits that use two power transistors have a cross-conduction problem when changing frequencies.

CIRCUIT START UP

The following elements, resistors R1 and R7, diode D7, diac D8, and capacitor C4 in FIG. 1 function to start up the circuit. When the circuit is initially turned on, capacitor C4 will begin charging. When an increasing positive or negative voltage is applied across the terminals of diac D8, a minimum (leakage) current flows through the device until the voltage reaches a break over point, in this case about 32 volts. The reverse-biased junction of the diac D8 then undergoes an avalanche breakdown. In this circuit, when diac D8 turns on it effectively connects the voltage across capacitor C4 to the base of transistor Q2 turning Q2 on and starting the resonating sequence. Current then flows from inductor LR-3 to the transistor Q2 collector. Diode D7 keeps capacitor C4 discharged while Q2 is turned on, consequently C4 will not charge again while the circuit is running.

Resistor R7 helps the circuit start up by providing a positive feedback. When the diac D8 turns transistor Q2 on, sometimes the pulse from LR-1 does not provide enough current to the base of transistor Q1 to turn Q1 on. When that happens, R7 helps to turn transistor Q1 on. This can happen during low voltage situations or during huge voltage variations (e.g., a brown-out). After Q1 turns on, R7 is effectively like an open circuit since its value is large (1M ohm in the preferred embodiment).

RESONATING CONFIGURATION AND LAMP DRIVE

The resonating elements of the circuit in FIG. 1 are the resonating inductor LR, the parallel loading capacitor C9 and the series resonating capacitor C8. The parallel loading capacitor C9 is needed in order to properly drive the lamps. Fluorescent lamps are characterized by a wide impedance variation. The impedance variation ambient temperature, etc. Capacitor C9 acts as an impedance buffer to the lamp impedance and at the same time provides a high voltage which is needed to strike the lamp during the startup process. The resonating current flowing through inductor LR is used to drive the half-bridge transistors Q1 and Q2 (see the discussion above). Since there are no saturable magnetic components used in driving transistors Q1 and Q2, the system is linear and easily controllable. The transformer T1 as shown in FIG. 1, does not play any significant role as a resonating component. The primary uses of transformer T1 are optimizing the power transfer from the circuit to the load and also providing electrical isolation between the load and the power line as required by UL Safety Standards.

Figure 6:
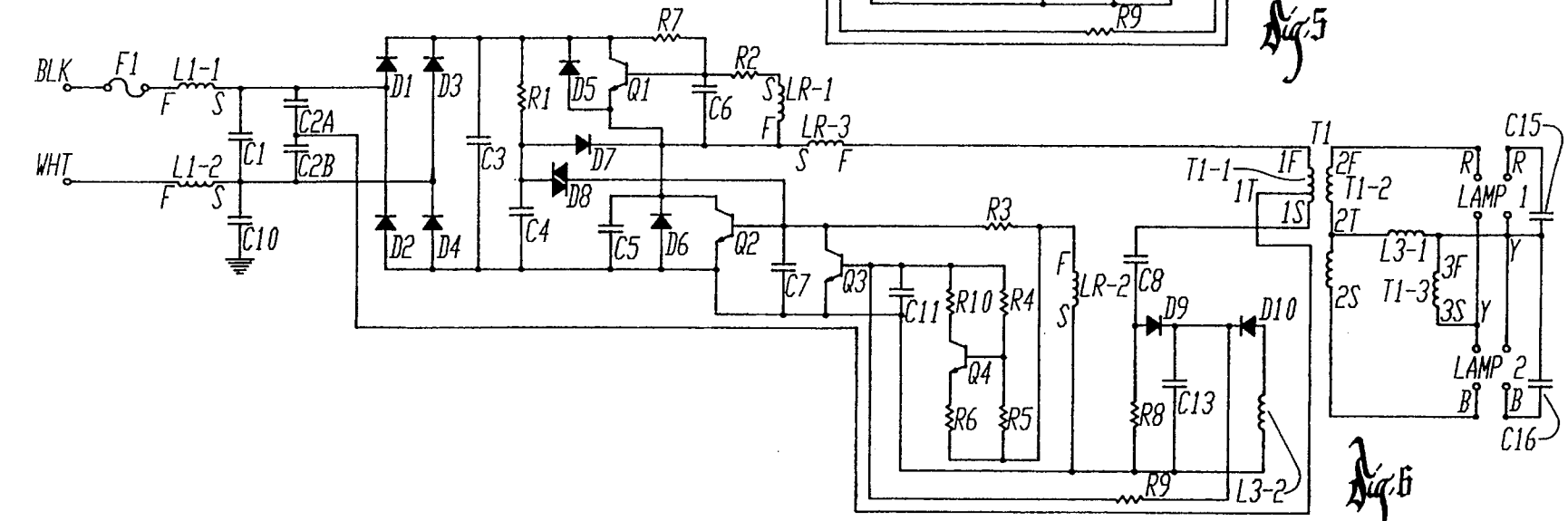
FIG. 6 shows a schematic circuit diagram of another alternative embodiment.

The circuit of the preferred embodiment has been described as driving a series lamp load. However, the present invention can be used to drive different types of loads. For example, FIG. 6 shows the present invention driving a parallel lamp load (see the discussion below).

POWER FEEDBACK AND INPUT PERFORMANCE CONSIDERATIONS

One purpose behind this circuit design is to optimize the power line input performance, namely the total harmonic distortion and the power factor. The main reason for poor power line input performance in prior art circuits using voltage rectification and energy storage capacitors is the non-linear characteristic of the rectifying diodes D1–D4. The diodes D1–D4 conduct current only when they are forward biased, which happens only for a very short period of time when the input voltage is near the peak of the voltage waveform. One solution to this problem is to expand the conduction time of the rectifying diodes D1–D4 by forcing the diodes to be forward biased for a longer period of time.

Some prior art circuits accomplish this with additional circuitry (for example, a "boost converter"). However, the extra circuitry required naturally requires more components which means more cost, more loss, more noise, more heat, and increased power consumption.

It is desired that the feedback voltage force the diodes D1–D4 to conduct over the entire input waveform. In the preferred embodiment of the present invention, a power feedback voltage is taken from a tap (1T in FIG. 1) on the primary side of the transformer T1. The tap 1T is coupled to a point between the capacitors C2*a* and C2*b*. The voltage at tap 1T is selected such that it will be greater in amplitude than the input line voltage. The tap voltage will "fool" the diodes D1–D4 and keep them forward biased.

The voltage at tap 1T is virtually constant in amplitude because fluorescent lamps are characterized by a constant voltage while in the operating mode. The constant voltage from tap 1T is applied via capacitors C2*a* and C2*b* to the rectifier stage diodes D1–D4 and will forward bias them, making the diodes D1–D4 conduct current over a large portion of the low frequency (60 Hz) cycle. The low frequency input current modulates in amplitude the high frequency feedback current which works as a carrier in order to transfer the low frequency input current through the bridge rectifier over most of the low frequency cycle. The bulk capacitor C3 will charge at a DC voltage level which is close to the peak of the feedback voltage.

This circuit configuration overcomes a fundamental problem associated with diode rectifiers, the intrinsic non-linear operating mode. In the present invention, the rectifier still performs the function of voltage rectification, but does so in a linear way. As a result, the total load looks nearly linear (resistive) at the AC line interface. This in turn improves the power factor and the total harmonic distortion. Also note that the desired results are accomplished without using any additional components like prior art circuits use.

This voltage feedback could be described as a voltage controlled capacitor controlled by the input voltage. For example, when the input voltage is 0 (at a 0 crossing) the diodes D1–D4 do not conduct and the values of C2*a* and C2*b* are virtually 0.

Figure 3:
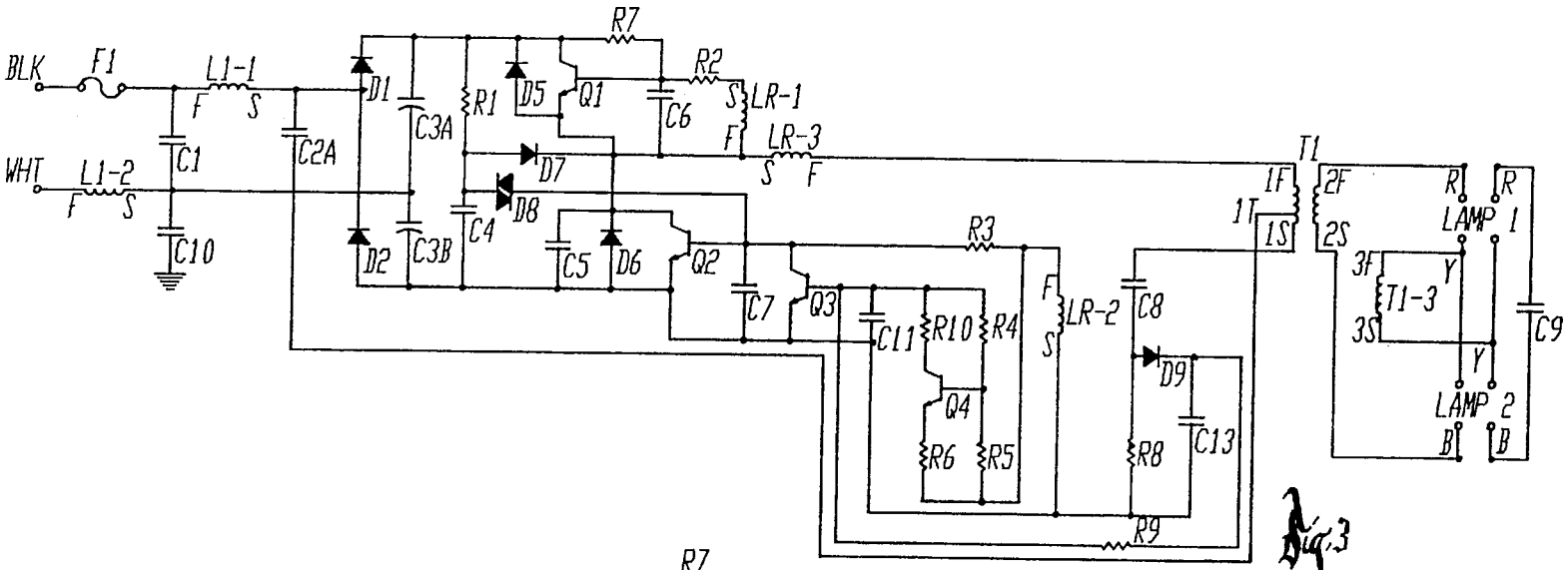
FIG. 3 shows a schematic circuit diagram of the preferred embodiment for use with 120 volt applications.
Figure 4:
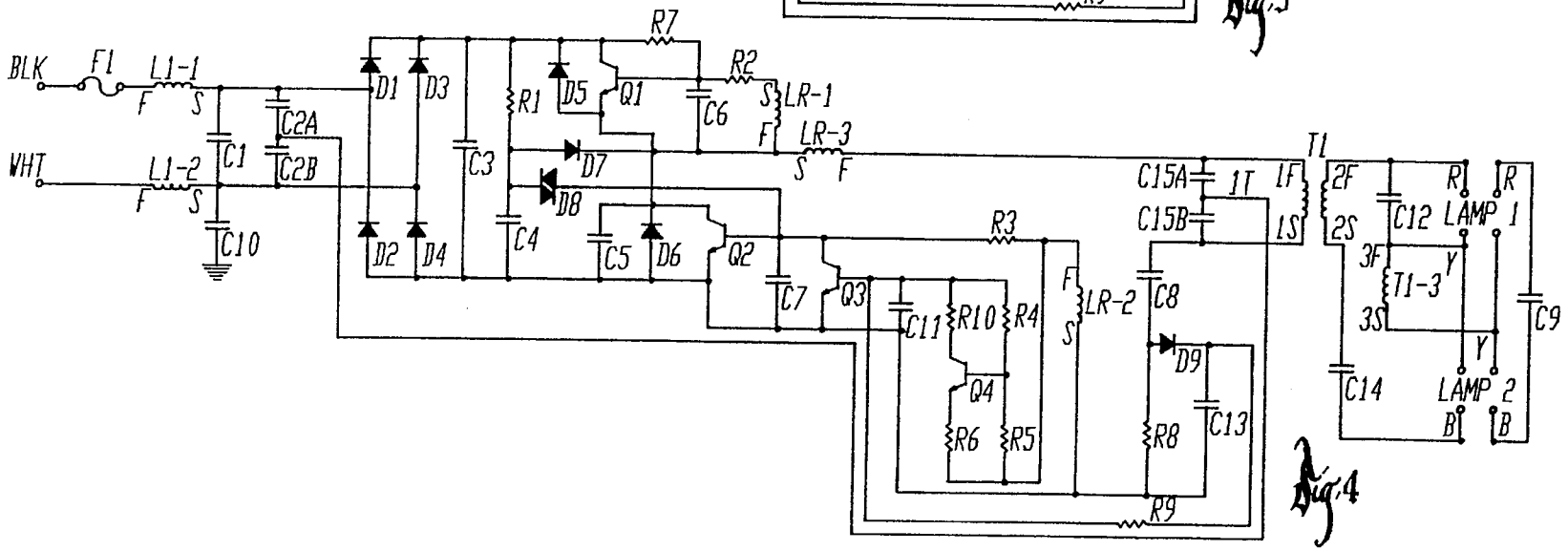
FIG. 4 shows a schematic circuit diagram of an alternative embodiment.
Figure 5:
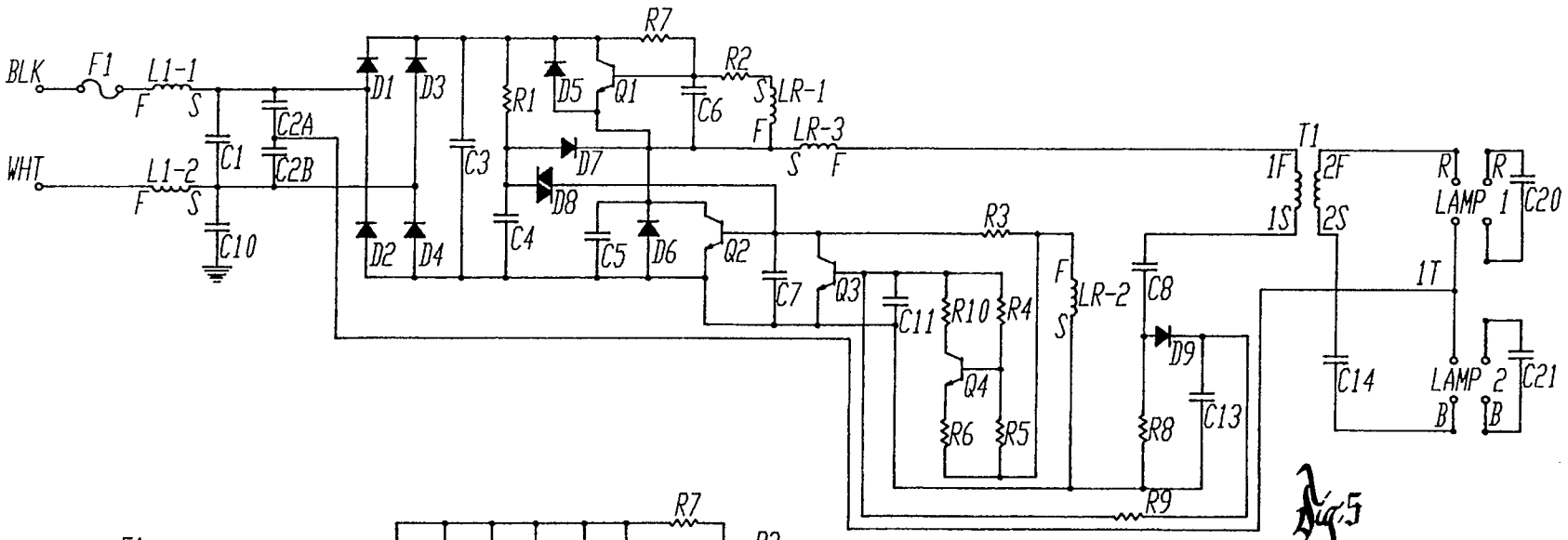
FIG. 5 shows a schematic circuit diagram of another alternative embodiment.

Please note that the preferred embodiment, shown in FIG. 1, is only one of many possible embodiments of the present invention. For example, FIG. 4 shows one alternative embodiment where the feedback is operatively coupled to the load at a point between two capacitors (C15*a* and C15*b*) in series with each other and in parallel to the primary side of transformer T1. The tap taken from a point between capacitors C15*a* and C15*b* as shown in FIG. 4 could also be used for circuits that do not use a transformer. Also, the tap could be taken from either side of the load. FIG. 5 shows another possible embodiment where a voltage is taken from the load side of the circuit. Of course, this voltage could also be taken from the transformer T1 (similar to FIG. 1) or from a point between two capacitors (similar to FIG. 4). One problem with some of these alternative embodiments is that the load would no longer be electrically isolated from the circuit. FIG. 3 shows another possible embodiment where a "voltage doubler" is utilized. This embodiment could be used in 120 volt applications. In FIG. 3, the voltage feedback is coupled to the AC side of the rectifier stage via capacitor C2*a*. These are only a few of many possible embodiments of the feedback circuit.

There are some prior art circuits that utilize a feedback circuit. However, these circuits can easily be distinguished from the present invention in that the feedback circuits were designed for totally different purposes. Also, all known prior art feedback circuits are coupled to the DC side of the circuit as opposed to the present invention where the feedback is coupled to the AC side of the circuit. This difference exists because the feedback circuits were designed for totally different purposes.

THE CONTROL CIRCUIT

The control circuit (included in FIG. 1) is designed to perform the following functions: lamp current crest factor correction, soft start operation, short circuit protection, open circuit protection, and lamp fault mode protection. The control circuit is primarily comprised of transistor Q3 which controls the duty cycle of the power transistor Q2. The duty cycle is controlled depending on the feedback received from the driving winding LR-2 and a current sense resistor RS. This is accomplished by monitoring the voltage from LR-2, correlating to the load voltage, and the current through R8, correlating to the load current. The voltage at LR-2 is sensed via the combination of C11 and the elements R4, R5, R10, R6 and Q4, which together behave as a "voltage controlled resistor". When transistor Q4 turns on, the total resistance through the voltage controlled resistor decreases. This turns on transistor Q3 which in turn turns off transistor Q2. The load current detected by resistor R8 is rectified by diode D9 and capacitor C13 and summed via resistor R9 with the current through the voltage controlled resistor at capacitor C11.

When the current from the voltage controlled resistor and R9 charge capacitor C11 to a certain threshold voltage, transistor Q3 will turn on. When transistor Q3 is turned on, transistor Q2 will turn off, terminating the cycle and limiting the power transferred to the load.

The lamp current crest factor correction is accomplished by combining the information from both the load voltage and the load current. The circuit of the preferred embodiment is designed to provide extra current to the load in the vicinity of the low frequency current 0 crossing. This is done by properly selecting the resonating elements as shown in FIG. 1 and Table 1. Another way to address the crest factor correction is by clipping the peaks of the load current waveform.

The soft start operation is accomplished by increasing the voltage across the load to a predetermined value during start up. This method provides an increased filament voltage and gives the circuit the freedom to ignite the lamps while the temperature and voltage conditions are being met.

The short circuit protection operation is accomplished primarily by detecting the load current via resistor R8 and limiting the power transferred to the load to an acceptable level such that the circuit is never over stressed. During a short circuit there is a high voltage across capacitor C13. Then transistor Q3 turns on which turns transistor Q2 off.

The open circuit protection is accomplished by eliminating resonant capacitor C9 from the circuit which limits the amount of resonating current in the system. When the voltage at the transformer increases, the voltage cross LR-2 increases which then turns transistor Q3 on. This then turns transistor Q2 off earlier than it otherwise would have.

The lamp fault mode protection is accomplished by controlling the load voltage and load current to a level which makes the current operation reliable and creates the proper conditions to re-ignite the lamp when the fault mode is detected without requiring the power to be turned off and back on.

Without the control circuit, a series half-bridge parallel loaded resonant circuit will operate into a self destructive mode for the open circuit, short circuit, and lamp fault conditions and would instant start the lamps rather than soft start the lamps.

The portion of the preferred embodiment that acts as a control circuit could be incorporated onto a single silicon substrate.

The preferred embodiment of the present invention also has a circuit protection mechanism that protects the circuit when the filaments (e.g., Y in FIG. 1) of the lamp fixture are shorted. Prior art circuits used a capacitor to protect the circuit against a short. A leakage inductance across the two terminals of the filament will protect the circuit from a short circuit. It is desired that enough leakage inductance be present to protect the circuit, but not enough inductance to interfere with the operation of the circuit. The solution to this problem is to wind around the core of T1 22 turns one way and 20 turns the opposite way. The leakage inductance of this configuration will protect the circuit from a short between the filaments. In the preferred embodiment this is shown by T1-3 in FIG. 1. In determining the value of T1-3, note that the total number of turns determines the leakage inductance and the difference between the two number of turns determines the voltage.

This is but one embodiment of the present invention, this embodiment as well as other embodiments or features are possible. It is not intended that the present invention be limited to the described embodiment.

Table 1 includes values for the components for the preferred embodiment. While these are the values of the preferred embodiment, it will be understood that the invention is not limited to these values.

In summary, the normal method of operation of the preferred embodiment of the present invention is as follows:

An AC line voltage is provided to the circuit and filtered through an EMI and transient suppression filter. The voltage is then rectified by a full wave bridge rectifier. Normally, the diodes in the bridge rectifier would only conduct current for a small amount of time (near the peaks of the AC voltage waveform). However, by providing a feedback voltage from the load of the circuit, the conduction time of the rectifying diodes is expanded. The low frequency input current modulates in amplitude the high frequency feedback current which works as a carrier to transfer the low frequency input current through the bridge rectifier over most of the low frequency cycle. This in turn decreases the total harmonic distortion and increases the power factor of the circuit.

The rectified voltage is connected to a power inverter which provides power to a load. The duty cycle of the power inverter is controlled by a control circuit depending on the feedback received from the resonating inductor.

It can be seen that the present invention achieves the stated objectives. The objectives are achieved while using less components, operating at a lower temperature, drawing less power, introducing less noise, costing less money, and improving the total harmonic distortion and power factor.

PARALLEL LAMP LOAD OPERATION

FIG. 6 shows an alternative embodiment of the present invention. The circuit in FIG. 6 drives a parallel lamp load, with very high efficiency for both two lamp and one lamp rapid start operation.

A typical prior art parallel circuit is described by two lamps connected in parallel with each lamp also having a capacitor in series with it. This configuration is less efficient because the additional voltage drop on the series capacitors translates into a voltage of about two to three times higher than the lamp operating voltage across the output of the load transformer. This increased voltage across the transformer translates into higher copper and core losses. In addition to the increased voltages, the current through the transformer is also increased since the lamps are truly in parallel in the prior art.

In FIG. 6, the lamps are connected in a series configuration with resonating capacitors C15 and C16 in parallel with each lamp. The load side of the transformer T1 is center tapped and connected to inductor L3-1 which is also connected to the series connection of the lamps.

During the initial turn on of the ballast, prior to ignition of the lamps, the transformer T1 supplies a voltage capable of igniting at least one lamp. Once one lamp is ignited (e.g. the red lamp), the current path for this lamp current is split between the capacitor across the other lamp (C16) and inductor L3-1. The voltage drop across capacitor C16 and inductor L3-1 will add together in order to generate the required voltage to strike the other lamp. After both lamps are ignited, the voltage drop across inductor L3-1 is virtually 0. Therefore, inductor L3-1 is effectively electrically disconnected from the circuit and does not consume any power. The current path through the lamps acts as a series connection and capacitors C15 and C16 connected in series represent the parallel loading resonating capacitor (similar to C9 in FIG. 1). The current passing through capacitors C15 and C16 provides filament heat for one end of each lamp.

When one lamp (e.g. the blue lamp) is removed, capacitor C16 is effectively removed from the circuit since the filament in the blue lamp no longer connects to it. The current path for the remaining red lamp is through inductor L3-1 with capacitor C15 acting as the parallel loading resonating capacitor. Electrically, inductor L3's inductance adds to the inductance of LR which limits the power transferred to the lamp to the required level. During the initial turn on of the single lamp, the voltage generated solely by half of the transformer T1 secondary winding is insufficient to ignite the lamp by itself. The circuit is designed such that a secondary resonance between inductor L3 and capacitor C15 will provide enough voltage that when added to the voltage across the half-secondary winding of transformer T1, it will be enough to reliably ignite the lamp.

If both lamps are removed from the circuit, or if both the red and the blue filaments burn out, the parallel resonating capacitors C15 and C16 are disconnected from the circuit and will not allow the circuit to oscillate. This essentially shuts down the circuit and the power consumed by the circuit is less than one watt.

If the yellow filaments are burned out and the red and blue filaments are still functional, the circuit will oscillate and be controlled by the control circuit as mentioned above. There is some power loss in this configuration, but the filaments are consuming a significant portion of the power and the circuit will not self-destruct.

If only one red or one blue filament is in tact while all the other filaments are open, a high current will pass through inductor L3-1. Since inductor L3-1 is coupled to inductor L3-2, it will sense the high current and feed a high level of current through diode D10 and resistor R9 to charge capacitor C11 and turn transistor T3 on which will shut off transistor Q2 early in its cycle, thus limiting the power consumption of the circuits so that it will not self-destruct.

The benefit of this circuit is that it is more efficient than prior art parallel loaded circuits. Although the voltage across the output transformer is roughly the same, the current through the transformer is almost 50% lower. This results in a power loss reduction. Also, when all the lamps are removed, the circuit shuts down and power consumption is less than one watt.

TABLE 1

| | | | | |
|---|---|---|---|---|
| C1 | 0.1 uF | 630V | | Metallized Polyester |
| C2a,b | 0.047 uF | 400V | | Metallized Polypropylene |
| C3 | 4.5 uF | 500V | | Dry Film |
| C3a,b | 33 uF | 500V | | Dry Film |
| C4,13 | 0.1 uF | 50V | | Ceramic |
| C5 | 470 pF | 1000V | | Ceramic |
| C6,7 | 0.22 uF | 50V | | Ceramic |
| C8 | 0.027 uF | 400V | | Metallized Polypropylene |
| C9 | 3.3 nF | 1000V | | Polypropylene |
| C10 | 1000 pF | 3000V | | Ceramic |
| C11 | 0.1 uF | 50V | | Ceramic |
| C12 | 220 pF | 3000V | | Ceramic |
| C14 | 0.1 uF | 100V | | Metallized Polyester |
| C15–21 | 6.8 nF | 1000V | | Polypropylene |
| D1–D6 | FR107GP | | | |
| D7 | 1N4007 | | | |
| D8 | 32V, Diac | | | |
| D9,10 | 1N4148 | | | |
| R1,7 | 1M | ¼W | 5% | CF |
| R2,3 | 47 ohm | ½W | 5% | CF |
| R4 | 18.2 ohm | ¼W | 1% | MF |
| R5 | 301 ohm | ¼W | 1% | MF |
| R6 | 44.2 ohm | ¼W | 5% | CF |
| R8 | 3.9 ohm | ½W | 5% | CF |
| R9 | 357 ohm | ¼W | 1% | MF |
| R10 | 301 ohm | ¼W | 1% | MF |
| Q1,2 | 2SC5021 | | | |
| Q3,4 | 2N3904 | | | |
| LI-1 | 2 mH | | | |
| LI-2 | 2 mH | | | |
| LR-1 | .7 uH | | | |
| LR-2 | .7 uH | | | |
| LR-3 | 3 mH | | | |
| T1 | | | | |
| 1S-1T | 50N | | | |
| 1T-1F | 85N | | | |
| 2S-2F | 206N | | | |

What is claimed is:

1. An electronic circuit with power factor correction comprising:

an input stage for receiving an AC input voltage supply;

a rectifier stage coupled to said input stage;

an energy storage capacitor;

said rectifier stage being coupled to said energy storage capacitor;

a power inverter including at least one switching device and a resonating circuit coupled to said energy storage capacitor;

a load coupled to said power inverter, said load including a transformer;

an inductor having a primary winding and at least one secondary winding, said primary winding being series connected to said transformer, wherein said at least one switching device being controlled by voltages across said secondary winding of said inductor; and a feedback circuit operatively coupled to said transformer and to a point between said input stage and said rectifier stage to create a path for transferring a feedback voltage over said rectifier stage to said energy storage capacitor allowing said rectifier stage to conduct current over a substantial portion of each cycle of the AC input voltage.

2. The electronic circuit of claim 1 wherein said electronic circuit comprises a ballast.

3. The electronic circuit of claim 1 wherein said at least one switching device comprises a transistor.

4. The electronic circuit of claim 1 wherein a control circuit is operatively coupled to said power inverter for controlling the duty cycle of said at least one switching device.

5. The electronic circuit of claim 1 wherein said feedback circuit is operatively coupled to said load on the primary side of said transformer.

6. The electronic circuit of claim 1 wherein said load includes a transformer, said feedback circuit being operatively coupled to said load on the load side of said transformer.

7. The electronic circuit of claim 1 wherein an EMI and transient suppression filter is operatively coupled to said input stage; said rectifier stage being operatively coupled to said EMI and transient suppression filter.

8. The electronic circuit of claim 7 wherein said feedback circuit is operatively coupled to said load and to a point between said EMI and transient suppression filter and said rectifier stage.

9. The electronic circuit of claim 1 further comprising a loading capacitor parallel coupled to said load.

10. The electronic circuit of claim 1 wherein said load includes a transformer and further comprises a loading capacitor parallel coupled to said transformer of said load.

11. The electronic circuit of claim 4 wherein said control circuit includes a voltage controlled resistor for controlling the duty cycle of at least one of said switching devices.

12. The electronic circuit of claim 1 further comprising a start-up circuit coupled to said rectifier stage.

13. The electronic circuit of claim 12 wherein said start-up circuit comprises a capacitor, said capacitor being charged until reaching a threshold voltage, at which time a voltage is supplied by said capacitor to said at least one switching device, thereby starting up said resonating circuit.

14. The electronic circuit of claim 12 wherein said start-up circuit includes a resistor coupled to a base and collector of said at least one switching device to help start-up said circuit.

15. The electronic circuit of claim 1 wherein said load includes a filament and wherein an inductor is coupled across said filament to protect said electronic circuit from a short circuit of said filament.

16. The electronic circuit of claim 15 wherein said transformer includes a transformer core and wherein said inductor is formed by a first number of windings wound around said transformer core in a first direction and a second number of windings wound around said transformer core in a direction opposite to said first direction.

17. The electronic circuit of claim 16 wherein said second number is greater than said first number.

18. The electronic circuit of claim 16 wherein said second number is two windings greater than said first number.

19. The electronic circuit of claim 16 wherein said first number of windings is 20 and said second number of windings is 22.

20. The electronic circuit of claim 7 wherein said EMI and transient suppression filter includes first and second inductors wound around a common core, said first inductor being in series with the positive side of the AC input voltage supply, said second inductor being in series with the negative side of the AC input voltage supply.

21. The electronic circuit of claim 1 wherein series connected first and second capacitors are parallel connected to said rectifier stage and wherein said feedback circuit is coupled to a point between said series connected first and second capacitors.

22. The electronic circuit of claim 1 wherein said load comprises a parallel lamp load.

23. The electronic circuit of claim 22 wherein said parallel lamp load further comprises:

a plurality of series coupled lamps;

a plurality of resonating capacitors each parallel coupled to one of said series coupled lamps;

an inductor coupled to the series coupled lamps at the point where the series coupled lamps are coupled together;

a tap taken from said transformer, said tap coupled to said inductor.

24. An electronic circuit comprising:

a rectifier stage having an AC side and a DC side, said rectifier stage coupled to a source of AC input voltage at said AC side to provide a DC voltage at said DC side;

a power inverter coupled to said DC side of said rectifier stage, said power inverter including at least one switching device;

a load coupled to said power inverter, said load including a transformer;

an inductor having at least one secondary winding, said inductor being series coupled with said transformer, wherein said switching device is controlled by a voltage across one of said at least one secondary winding of said inductor;

a feedback circuit operatively coupled to said transformer and operatively coupled to said AC side of said rectifier stage to create a path for transferring a feedback voltage through said rectifier stage thereby allowing said rectifier stage to conduct current over a substantial portion of the cycle of the input voltage.

25. The electronic circuit of claim 24 wherein said transformer has a primary side and a secondary side.

26. The electronic circuit of claim 24 wherein a control circuit is operatively coupled to said power inverter for controlling the duty cycle of said power inverter.

27. The electronic circuit of claim 24 wherein said feedback circuit is operatively coupled to said load and to said AC side of said rectifier stage to create a path for transferring a feedback voltage through said rectifier stage allowing said rectifier stage to conduct current over a substantial portion of the cycle of the input voltage thereby making said load appear linear at said AC side of said rectifier stage.

28. The electronic circuit of claim 24 wherein said electronic circuit comprises a ballast.

29. The electronic circuit of claim 25 wherein said feedback circuit is operatively coupled to said load on the primary side of said transformer.

30. The electronic circuit of claim 24 wherein said load includes a transformer, said feedback circuit is operatively coupled to said load on load side of said transformer.

31. The electronic circuit of claim 24 wherein an EMI and transient suppression filter is operatively coupled to said rectifier stage.

32. The electronic circuit of claim 31 wherein said feedback circuit is operatively coupled to said load and to a point between said EMI and transient suppression filter and said rectifier stage.

33. The electronic circuit of claim 24 further comprising a loading capacitor parallel coupled to said load.

34. The electronic circuit of claim 24 wherein said load includes a transformer and further comprising a loading capacitor parallel coupled to said transformer.

35. The electronic circuit of claim 26 wherein said power inverter includes at least one switching device and wherein said control circuit includes a voltage controlled resistor for controlling the duty cycle of said power inverter.

36. The electronic circuit of claim 35 wherein said at least one switching device comprises a transistor.

37. The electronic circuit of claim 24 further comprising a start-up circuit coupled to said rectifier stage.

38. The electronic circuit of claim 37 wherein said start-up circuit comprises a capacitor and wherein said power inverter includes at least one switching device and wherein said power inverter includes a resonating circuit; said capacitor being charged until reaching a threshold voltage, at which time a rectified voltage is supplied to said at least one switching device, starting up said resonating circuit.

39. The electronic circuit of claim 37 wherein said power inverter includes at least one switching device and said start-up circuit includes a resistor coupled to a base and collector of one of said at least one switching device to help start-up said circuit.

40. The electronic circuit of claim 24 wherein said load includes a filament and wherein an inductor is coupled across said filament to protect said electronic circuit from a short circuit of said filament.

41. The electronic circuit of claim 40, wherein said transformer includes a transformer core and wherein said inductor is formed by a first number of windings wound around said transformer core in a first direction and a second number of windings wound around said transformer core in a direction opposite to said first direction.

42. The electronic circuit of claim 41 wherein said second number is greater than said first number.

43. The electronic circuit of claim 41 wherein said second number is two windings greater than said first number.

44. The electronic circuit of claim 41 wherein said first number of windings is 20 and said second number of windings is 22.

45. The electronic circuit of claim 31 wherein said EMI and transient suppression filter includes first and second inductors wound around a common core, said first inductor being in series with the positive side of the AC input voltage supply, said second inductor being in series with the negative side of the AC input voltage supply.

46. The electronic circuit of claim 24 wherein series connected first and second capacitors are parallel connected to said rectifier stage and wherein said feedback circuit is coupled to a point between said first and second capacitors.

47. The electronic circuit of claim 25 wherein first and second series connected capacitors are parallel coupled to said transformer and wherein said feedback circuit is operatively coupled to said first and second series connected capacitors.

48. The electronic circuit of claim 47 wherein an electrical connection means electrically series connects said first and second capacitors and wherein said feedback circuit is operatively coupled to said electrical connection means.

49. The electronic circuit of claim 24 wherein said load comprises a parallel lamp load.

50. The electronic circuit of claim 49 wherein said parallel lamp load further comprises:

a transformer;

a plurality of series coupled lamps;

a plurality of resonating capacitors each parallel coupled to one of said lamps;

an inductor coupled to said series coupling of said lamps;

a tap taken from said transformer, said tap coupled to said inductor.

51. The electronic circuit of claim 1 wherein said input stage and rectifier stage function as a voltage doubler for higher voltage applications.

52. The electronic circuit of claim 51 wherein said input stage further comprises:

a first inductor, said first inductor in series with the negative side of the AC input voltage supply;

a second inductor, said second inductor in series with the positive side of the AC input voltage; and a capacitor, said capacitor coupled to the positive side of the AC input voltage and to said first inductor.

53. The electronic circuit of claim 52 further comprising a capacitor, said capacitor coupled to said feedback circuit and to said rectifier stage.

54. An electronic circuit for driving a lamp load comprising:

a power supply circuit with an input stage;

a transformer, said transformer coupled to said power supply circuit;

a feedback circuit operatively coupled to the transformer and the input stage;

a lamp load including at least one filament, said lamp load coupled to said transformer;

an inductor, said inductor coupled across said filament to protect said electronic circuit from a short circuit of said filament; and wherein said transformer includes a transformer core and wherein said inductor is formed by a first number of windings wound around said transformer core in a first direction and a second number of windings wound around said transformer core in a direction opposite to said first direction.

55. The electronic circuit of claim 54 wherein said second number is greater than said first number.

56. The electronic circuit of claim 54 wherein said second number is two windings greater then said first number.

57. The electronic circuit of claim 54 wherein said first number of windings is 20 and said second number of windings is 22.

58. An electronic circuit for driving a parallel lamp load comprising:

a power supply circuit with an input stage;

a transformer, said transformer coupled to said power supply circuit;

a feedback circuit operatively coupled to the transformer and the input stage;

a plurality of series coupled lamps;

a plurality of resonating capacitors each parallel coupled to one of said lamps;

an inductor coupled to said series coupling of said lamps;

a tap taken from the center of said transformer, wherein said inductor is coupled between said tap and said series coupling of said lamps.

59. The electronic circuit of claim 58 wherein said inductor has a secondary winding, said secondary winding being coupled to said power supply circuit to control the power consumption of said electronic circuit when said lamps fail.

60. A method of increasing the power line input performance of an electronic ballast coupled to a load, said load including a load transformer having primary and secondary sides, said ballast including a rectifier stage having an AC side and a DC side; a power inverter coupled to said DC side of said rectifier stage; said power inverter being coupled to said load for providing a voltage to the load transformer; comprising the steps of:

providing an input line voltage to the AC side of the rectifier stage;

providing a voltage tap from the primary side of the load transformer;

selecting the value of the voltage tap so that the value of the voltage tap is greater in amplitude than the input line voltage and less in amplitude than the voltage provided to the load transformer by the power inverter;

coupling said voltage tap, through a feedback circuit, to said AC side of said rectifier stage so that the conduction time of said rectifier stage is increased.

61. A method of claim 60 wherein the conduction time of said rectifier stage is increased by said feedback circuit to substantially all of the cycle of the input voltage of the power line input.

62. A method of increasing the power line input performance of an electronic ballast coupled to a load, said load including a transformer having primary and secondary sides, said ballast including a rectifier stage having an AC side and a DC side; a power inverter coupled to said DC side of said rectifier stage; said power inverter being coupled to said load for providing the load with an output voltage; comprising the steps of:

providing an input line voltage to the AC side of the rectifier stage;

determining the amplitude of the input line voltage;

providing a voltage tap to one of the sides of the transformer to provide a voltage to the voltage tap;

choosing the location of the voltage tap such that the resulting voltage provided to the voltage tap has an amplitude more than the amplitude of the input line voltage and less than the amplitude of the output voltage provided to the load;

increasing the conduction time of said rectifier stage by taking the voltage supplied to the voltage tap and supplying the same to said AC side of rectifier stage.

* * * * *